US006672781B1

(12) United States Patent
Takeda et al.

(10) Patent No.: US 6,672,781 B1
(45) Date of Patent: Jan. 6, 2004

(54) REDUCED NOISE KEY UNIT

(75) Inventors: Toshisada Takeda, Simi Valley, CA (US); Bryan Kang, Woodland Hills, CA (US); Yoshinori Kobayashi, Chatsworth, CA (US)

(73) Assignee: Minebea Co., Ltd. (JP)

( * ) Notice: Subject to any disclaimer, the term of this patent is extended or adjusted under 35 U.S.C. 154(b) by 0 days.

(21) Appl. No.: 09/560,077

(22) Filed: Apr. 27, 2000

(51) Int. Cl.[7] ..... H01H 13/70

(52) U.S. Cl. ..... 400/491; 400/490; 400/491.2; 400/495.1; 200/301; 200/345

(58) Field of Search ..... 400/490, 491, 400/491.1, 491.2, 689, 690, 480, 481, 495, 495.1; 200/341, 342, 343, 344, 345, 301

(56) References Cited

U.S. PATENT DOCUMENTS

| | | | | | |
|---|---|---|---|---|---|
| 4,515,999 | A | * | 5/1985 | Harper | 200/342 |
| 4,641,004 | A | * | 2/1987 | Keprda | 200/302.2 |
| 4,677,600 | A | | 6/1987 | Yoshida | |
| 4,803,316 | A | * | 2/1989 | Hayashi et al. | 200/406 |
| 4,939,324 | A | * | 7/1990 | English et al. | 200/345 |
| 5,120,923 | A | * | 6/1992 | Kato et al. | 200/520 |
| 5,144,103 | A | * | 9/1992 | Suwa | 200/344 |
| 5,247,143 | A | * | 9/1993 | Suwa | 200/344 |
| 5,380,969 | A | * | 1/1995 | Yang | 200/517 |
| 5,396,038 | A | * | 3/1995 | Yamada | 200/517 |
| 5,418,530 | A | * | 5/1995 | Moore et al. | 341/22 |
| 5,456,541 | A | | 10/1995 | Ching-Shui | |
| 5,516,996 | A | | 5/1996 | Shin | |
| 5,565,865 | A | | 10/1996 | So | |
| 5,710,397 | A | * | 1/1998 | Liao | 200/5 A |
| 5,794,762 | A | * | 8/1998 | Tsai | 200/345 |
| 6,056,457 | A | * | 5/2000 | Chao | 400/472 |
| 6,171,003 | B1 | * | 1/2001 | Lo | 400/495 |
| 6,204,462 | B1 | * | 3/2001 | Huang | 200/345 |
| 6,224,278 | B1 | * | 5/2001 | Nishi | 400/495 |
| 6,224,279 | B1 | * | 5/2001 | Nielsen et al. | 400/495 |

* cited by examiner

*Primary Examiner*—Stephen R. Funk
*Assistant Examiner*—Kevin D. Williams
(74) *Attorney, Agent, or Firm*—Schulte Roth & Zabel; Joel Lutzker; Anna Vishev

(57) ABSTRACT

A key unit of a keyboard apparatus having at least one bumper extending from the key unit for cushioning the impact of the key unit against the enclosure of the keyboard apparatus when the key unit assumes a depressed position and/or when the key unit resumes a non-depressed position, thereby eliminating or reducing the feedback noise, while retaining the benefits of a pre-loaded feature for the key unit.

16 Claims, 7 Drawing Sheets

REDUCED NOISE KEY UNIT

FIELD OF INVENTION

The present invention relates generally to a keyboard apparatus used for electronic equipment such as personal computers, typewriters, calculators, word processors and the like, and, more particularly, to a key unit in a keyboard apparatus, as well as the keyboard apparatus itself, wherein the key unit is adapted to reduce the noise which is typically generated when a key unit is pushed or returns from the depressed position and hits the top plate of a keyboard or other type of shell around the key unit.

BACKGROUND OF THE INVENTION

Keyboards are known as signal input devices that allow transmission of a relevant signal to a host device in response to the mechanical pressure being applied to a certain key unit out of a plurality of key units disposed in a predetermined positional relationship on a board in an electronic device or equipment. While keyboards are used in a variety of different electronic devices, the keyboards utilized in these devices usually perform the same function. Namely, an individual key unit of a plurality of key units of a keyboard usually consists of a key button that can be depressed by application of the mechanical pressure to the top of the key button, urging the key unit into movable contact with a contact point on a conductive membrane formed on a circuit substrate of the keyboard, which produces an electrical connection and causes a signal to be sent to the host device. Examples of various keyboard devices and their operation are well known in the art and disclosed in U.S. Pat. Nos. 4,677,600, 5,516,996 and 5,565,865.

Generally, there are many types of different key units that can be utilized in a keyboard. For example, U.S. Pat. No. 5,456,541 describes resilient rubber, spring and mechanical types of key units. Similarly, a resilient rubber key unit is described in U.S. Pat. No. 5,565,865.

In a conventional key unit, the key unit has a resilient pad, usually made of a resilient rubber or silicon rubber material, and a plastic keycap that is mounted on top of the resilient pad. The plastic keycap extends in the axial direction through the pre-determined opening in the top plate of the keyboard to accommodate the axial movement of the pad and keycap in response to the mechanical pressure in the axial direction that is applied by the keyboard operator to the top surface of the plastic keycap. The resilient pad is mounted over a conductive membrane sheet structure.

Electrical conductivity is provided in a conventional conductive membrane sheet structure below the resilient pad which is formed by stacking a lower sheet and an upper sheet, on which conduction layers are formed respectively. The bottom surface of the resilient pad has a stem portion that moves in unison with the pad in the axial direction and affects the contact between the fixed contact on the lower sheet of the conductive membrane sheet structure formed on a circuit substrate and the movable contact of the upper sheet. The upper and lower sheets of the conductive membrane sheet structure are separated from each other by a predetermined gap or an air pocket formed by the spacer inserted therebetween. When the stem portion of the resilient pad urges the movable contact of the upper sheet into physical contact with the fixed contact of the lower sheet an electrical circuit is established. Alternatively, electric conductivity is provided by a semi membrane or a PCB type of conductive membrane, which comprise a single conductive layer formed on a membrane sheet or circuit substrate. When the stem portion of the resilient pad is urged in the axial direction a conductive portion of the stem portion completes an electric circuit between a fixed row contact point and a fixed column contact point.

In addition, a conventional key unit may have a "pre-loaded" feature which is accomplished by using a flange on the keycap to limit the axial movement of the key unit. The flange contacts a pair of plastic ribs which are fixedly suspended from the inner surface of a top plate of the keyboard apparatus. These plastic ribs act as a stop and limit the axial movement of the key unit when it returns from a depressed position to its normal position.

The pre-loading is typically used to add stability and insure a constant height of the keycap. However, because the keycap is pre-loaded, each time a user depresses and thereafter releases the key unit, the flange of the keycap, strikes against the plastic ribs creating an undesirable impact and noise, often referred to as "feedback noise." Therefore, there is a need for an improved keyboard apparatus, in which the key units of the keyboard apparatus have the "pre-loaded" feature and associated advantages, but do not produce the impact and noise associated with the operation of conventional key units. Reduction of the impact and noise associated with the operation of keyboards in personal computers is particularly desirable because these devices are often used in enclosed public places, such as schoolrooms, on airplanes, and in large open office spaces that are subdivided into individual work areas, where the noise can be distracting and degrade productivity.

SUMMARY OF THE INVENTION

It is an object of the current invention to provide a keyboard apparatus that either eliminates or reduces the "feedback noise" during its operation.

Another object of the current invention is to provide an improved key unit which may be one of a variety of different types that has "pre-loaded" functionality and eliminates the above-mentioned feedback noise and impact, thereby providing a cost-effective solution to keyboard manufacturers, without limiting them to only one type of key unit.

A further object of the present invention is to provide an improved key unit for various types of electronic devices that utilize a keyboard with one or a plurality of key units, where the improved key unit contains means for cushioning the impact of a key unit against the top enclosure of a keyboard, thereby eliminating the feedback noise, and at the same time retaining the benefits of a "pre-loaded" feature for a key unit.

These and other objects of the invention are accomplished by providing a key unit having at least one resilient bumper positioned on or extending from the key unit which cushions the impact of the key unit against the top plate of the keyboard when the key unit returns from a depressed position to a normal pre-loaded position. The resilient bumper may be incorporated in a variety of different types of key units such as a resilient rubber type, spring type, mechanical type or any other type of key unit that may or may not contain a plastic keycap that covers the movable portions or key pad of the key unit.

These and other objects of the invention are accomplished by providing a key unit that is able to assume a depressed position comprising in one embodiment a member movable in a defined direction in response to pressure, the member having at least one resilient bumper. The key unit is a component of an apparatus that has a stop that restricts the movement of the key unit when the key unit is returned from the depressed position. In addition, the bumper of the key unit is movable into contact with the stop of the apparatus when the key unit is pushed or returned from the depressed position.

These and other objects of the invention are accomplished by providing an apparatus comprising at least one such key unit.

BRIEF DESCRIPTION OF THE DRAWINGS

These and other objects, features and advantages of the invention, its construction and operation will be best understood from the following detailed description of preferred embodiments of the present invention, taken in conjunction with the accompanying drawings, of which.

DETAILED DESCRIPTION OF THE INVENTION

Figure 1:
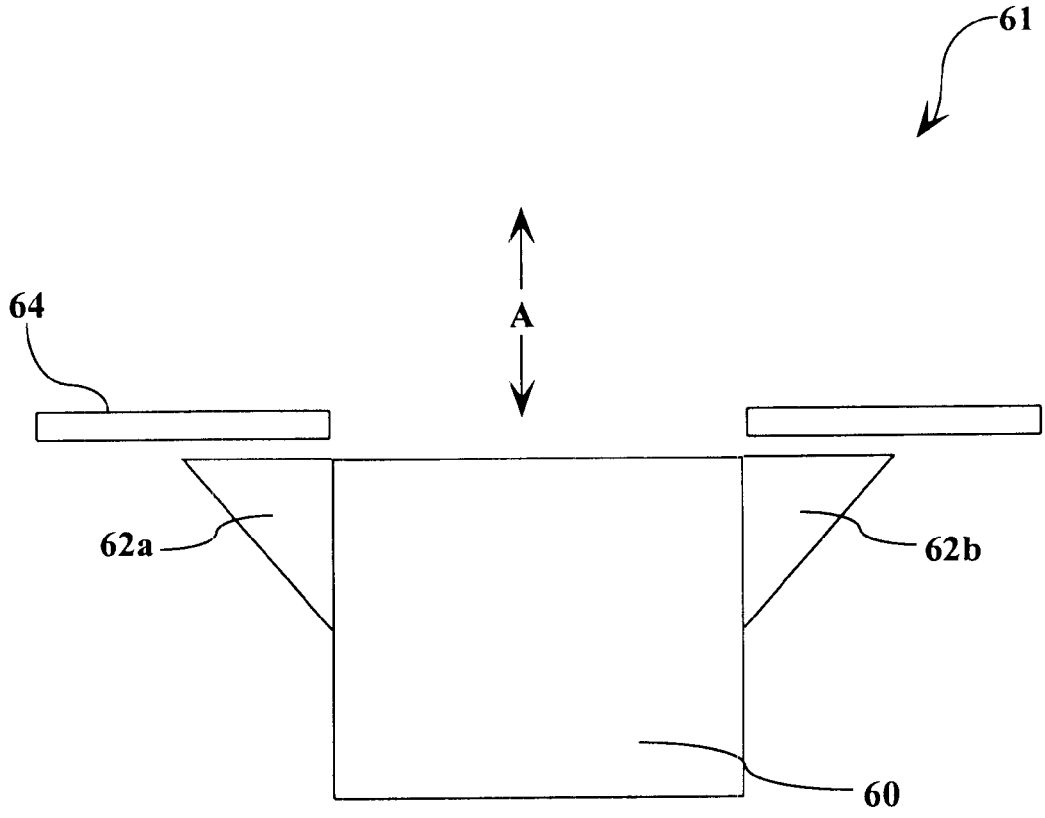
FIG. 1 is a disassembled view of a key unit according to the present invention.

The key unit according to the present invention will now be discussed with reference to the drawings in FIGS. 1 through 6 in which like reference numerals denote corresponding parts. FIG. 1 illustrates a key unit 61 according to the present invention comprising a member 60 having bumpers 62*a* and 62*b*. In operation, the member 60 is moveable in the directions shown by the arrow A. Member 60 is included in an apparatus having a stop 64 which impacts bumpers 62*a* and 62*b* when member 60 moves upwards in the direction shown by arrow A. Member 60 assumes a depressed position in response to a condition, such as pressure exerted by a keyboard operator on the key unit 61, and in the absence of the condition, resumes a normal position. Member 60 is either a single restorative component, as shown, or includes at least one restorative component, which is capable of responding to the absence of a condition, such as pressure, by restoring attached or physically proximate components to their normal position. The restoration component of member 60 is resilient or otherwise acts against the condition (i.e., the pressure exerted by the keyboard operator). In the absence of the condition, member 60 resumes a non-depressed position, which restores other components of the key unit which are attached to member 60 or physically proximate to member 60 to their normal position. Member 60 may produce a counter force in response to pressure and may store energy which, in the absence of pressure, restores attached or physically proximate components to their normal position.

In the case of member 60 being a single restorative component, exemplary embodiments of member 60 include but are not limited to a pad made of resilient material, such as silicon rubber, or any other type of rubber, a spring, a coil, an elastic band, a mechanical device operating using for example, hydraulics or magnetic forces or any other component capable of assuming a depressed position in response to a condition and in the absence of the condition, resuming a non-depressed position. If member 60 comprises a single component, bumpers 62*a* and 62*b* are attached to member 60, or alternatively, bumpers 62*a* and 62*b* and member 60 are made as a one-piece unit.

In the case of member 60 being more than one component comprising at least one restorative component, member 60 may be a combination of hard plastic key cap or key top or any other component or combination of components used with at least one restorative component such as a pad made of resilient material, such as silicon rubber, or any other type of rubber, a spring, a coil, an elastic band, a mechanical device operating using for example, hydraulics or magnetic forces or any other component capable of assuming a depressed position in response to a condition and in the absence of the condition resuming a non-depressed position. If member 60 comprises more than one component, bumpers 62*a* and 62*b* may be attached to or manufactured as a one-piece unit with any component of member 60 which allows bumpers 62*a* and 62*b* to extend from member 60 and impact stop 64. Bumpers 62*a* and 62*b* may be attached to or manufactured as a one-piece unit with a restorative component of member 60 as long as bumpers 62*a* and 62*b* do not excessively impede the restoration capabilities of the restorative component.

As can be seen from FIG. 1, bumpers 62*a* and 62*b* extend from member 60 and cushion the impact of member 60 when member 60 returns to a normal position which reduces or eliminates feedback noise. Bumpers 62*a* and 62*b* are made of resilient or cushioning material, such as silicon rubber or any other rubber or resilient material, Styrofoam, or foam. Bumpers 62*a* and 62*b* may be ribs, ridges or extensions of member 60. As shown, bumpers 62*a* and 62*b* cushion impact between member 60 and the stop 64 of the apparatus when member 60 resumes a normal, non-depressed position. Alternatively, or in addition, bumpers 62*a* and 62*b* may cushion impact between member 60 and the stop 64 of the apparatus when member 60 assumes a depressed position. Bumpers 62*a* and 62*b* may be used for a pre-loaded key unit.

Figure 2:
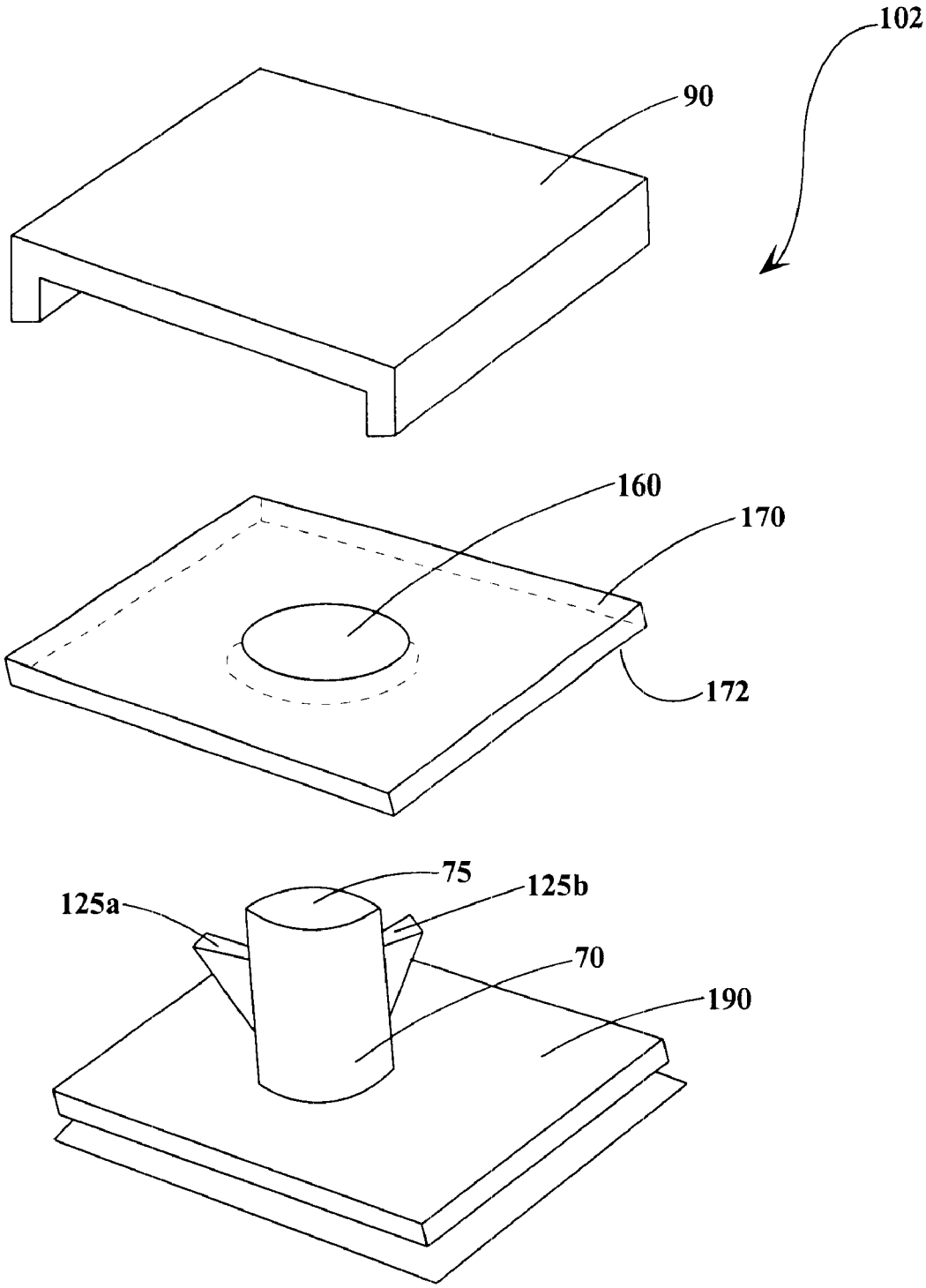
FIG. 2 is a disassembled view of a first type of a key unit according to the present invention.

FIG. 2 illustrates a first embodiment of the present invention, key unit 102. The key unit 102 which is able to assume a depressed position comprises a member where the member is a resilient pad 70 movable in a defined direction (up and down in the axial direction) in response to pressure. The pressure is exerted by a keyboard operator pushing the top surface 75 of resilient pad 70. The resilient pad 70 has resilient bumpers 125*a* and 125*b*. The bumpers 125*a* and 125*b* are protrusions from the sides of the resilient pad 70. The resilient pad 70 with bumpers 125*a* and 125*b* are movable in the axial direction into contact with stop 170 when the key unit 102 is returned from the depressed position. The stop 170 is the top plate of the keyboard having inner surface 172 and pre-determined opening 160. The resilient pad 70 extends in the axial direction through the pre-determined opening 160 in the top plate 170. The resilient pad 70 is preferably made of a rubber material, such as, for example, silicon rubber. A key cover 90 may be attached (directly or indirectly) to the top surface 75 of the resilient pad 70. In that case, the keyboard operator pushes the key cover 90 to depress the key. Key cover 90 is made of plastic, or any other material which is resistant to wear due to pushing, and indicia of the key unit, such as an alphanumeric symbol or other indicia may be printed or engraved on the key cover 90.

Figure 3A:
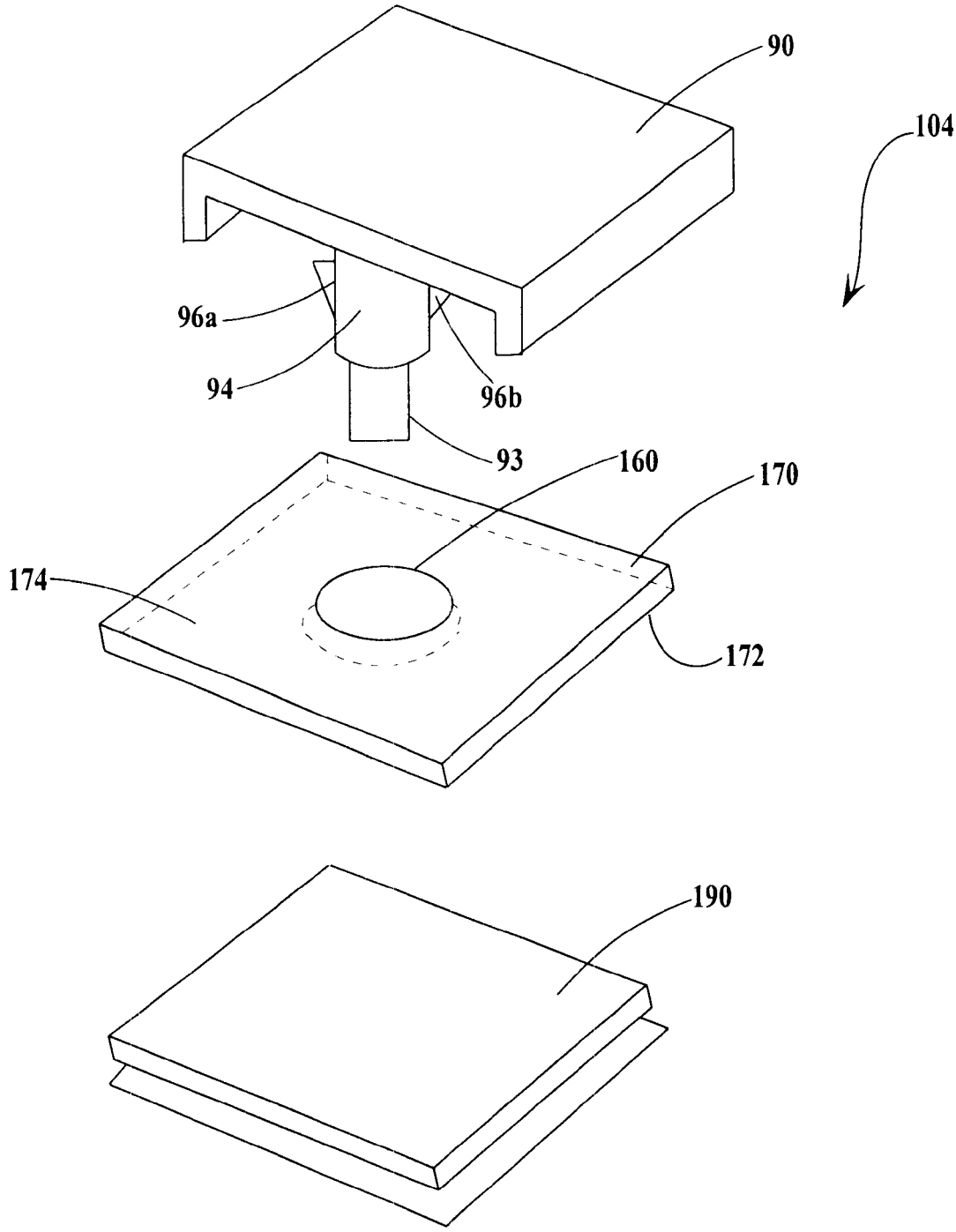
FIG. 3A is a disassembled view of a second type of a key unit according to the present invention.

FIG. 3A illustrates a second embodiment of the present invention, key unit 104. Key unit 104 comprises a member, where the member includes a base 94 which is movable in a defined direction (up and down in the axial direction) in response to pressure exerted by a keyboard operator pushing key cover 90 thereby allowing key unit 104 to assume a depressed position. Key cover 90 may be fixed to or rest directly on the top surface (not shown) of base 94 or key cover 90 and base 94 may be manufactured as a single piece. Base 94 has bumpers 96*a* and 96*b*. Bumpers 96*a* and 96*b* protrude from the sides of base 94 and are movable in the axial direction into contact with stop 170 when the key unit 104 is returned from the depressed position. The member of key unit 104 also includes a restorative device 93 which is attached to the bottom surface of the base 94 when key unit 104 is assembled. When pressure is exerted by the keyboard operator, conductive layer 190 moves downward to cause contact which forms an electrical circuit and produces a signal to the keyboard apparatus. The restorative device acts against the pressure by the operator. When the keyboard operator ceases to apply pressure, the natural elasticity of conductive layer 190 breaks the electrical connection so that no further signal is produced to the keyboard. Restorative device 93 responds by restoring base 94 and bumpers 96*a* and 96*b* to their normal position.

The base 94 may extend in the axial direction through the predetermined opening 160 in the top plate 170 or alternatively, only the restorative device 93 may extend through the predetermined opening 160. The base 94 need not be made of a resilient material but may be made of plastic, or any other non-resilient material.

Figure 3B:
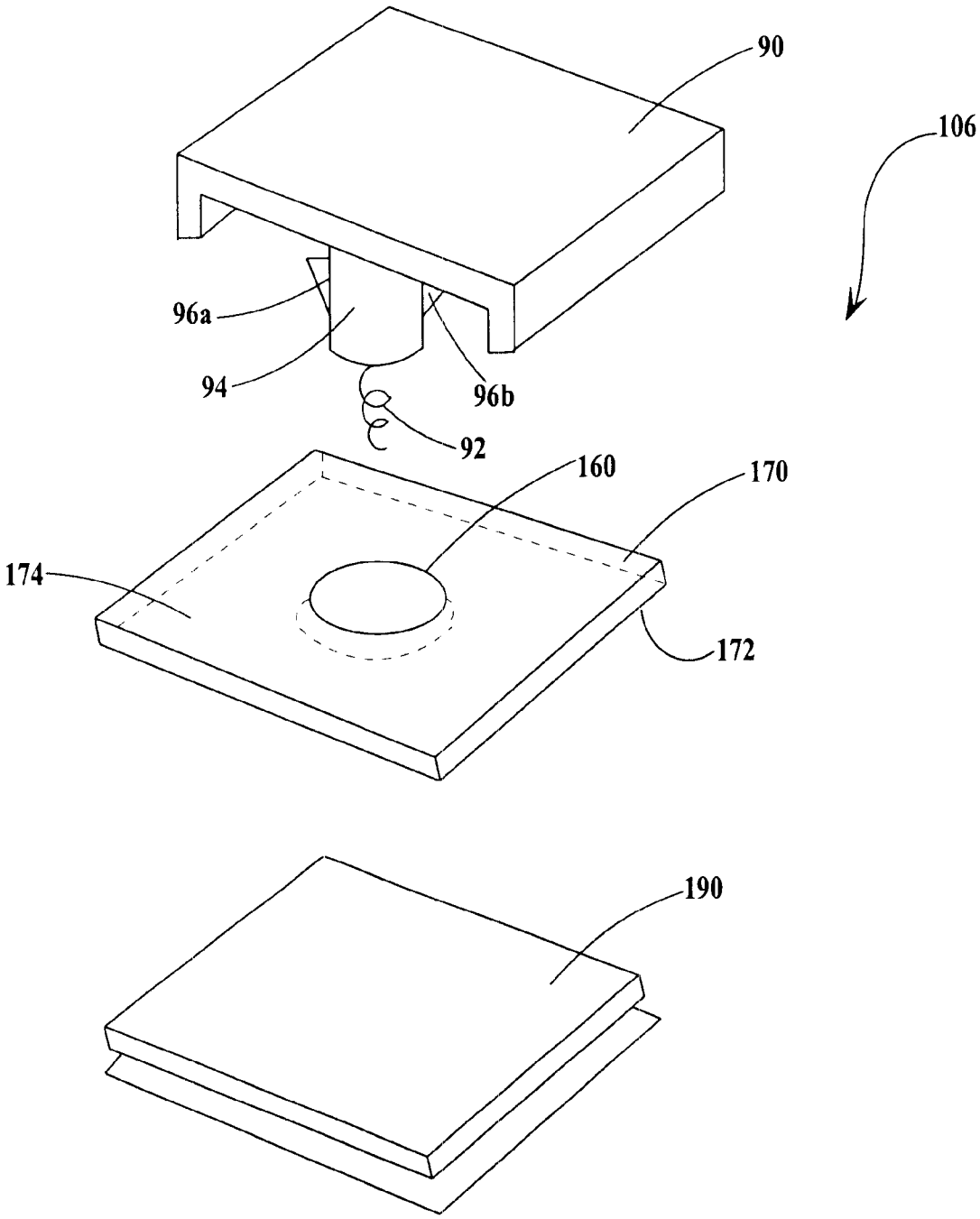
FIG. 3B is a disassembled view of a third type of a key unit according to the present invention.

In an alternative embodiment, as shown in FIG. 3B, the member is made of base 94 and restorative device 93. The restorative device 93 of key unit 106 is a resilient spring 92 which is connected to the bottom surface of base 94.

Figure 4:
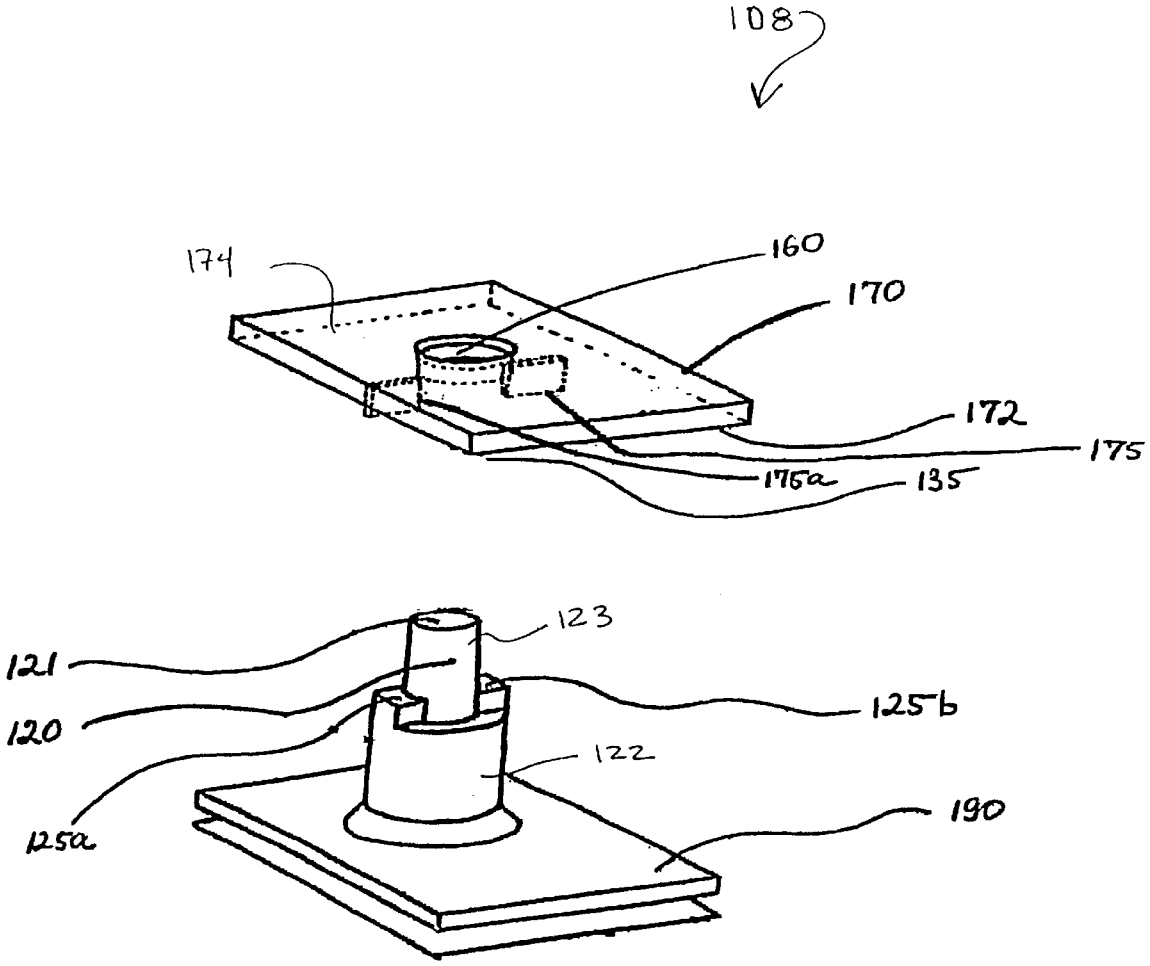
FIG. 4 is a disassembled view of a fourth type of key unit according to the invention.

FIG. 4 illustrates a fourth embodiment of the present invention in which the key unit comprises resilient pad 120 having a thick lower portion 122 and a thin upper portion 123. In this embodiment, the stop is provided by a pair of ribs 175*a* and 175*b* on the inner surface 172 of top plate 170. The thinner portion 123 of resilient pad 120 extends in the axial direction through the pre-determined opening 160 in the top plate 170. Since this embodiment does not include key cover 90, the keyboard operator applies pressure directly to the top of thinner portion 123 thereby producing movement of the pad in the axial direction. In this embodiment, the indicia of the key unit, such as an alphanumeric symbol or other indicia is printed on the top surface 174 of top plate 170.

Figure 5:
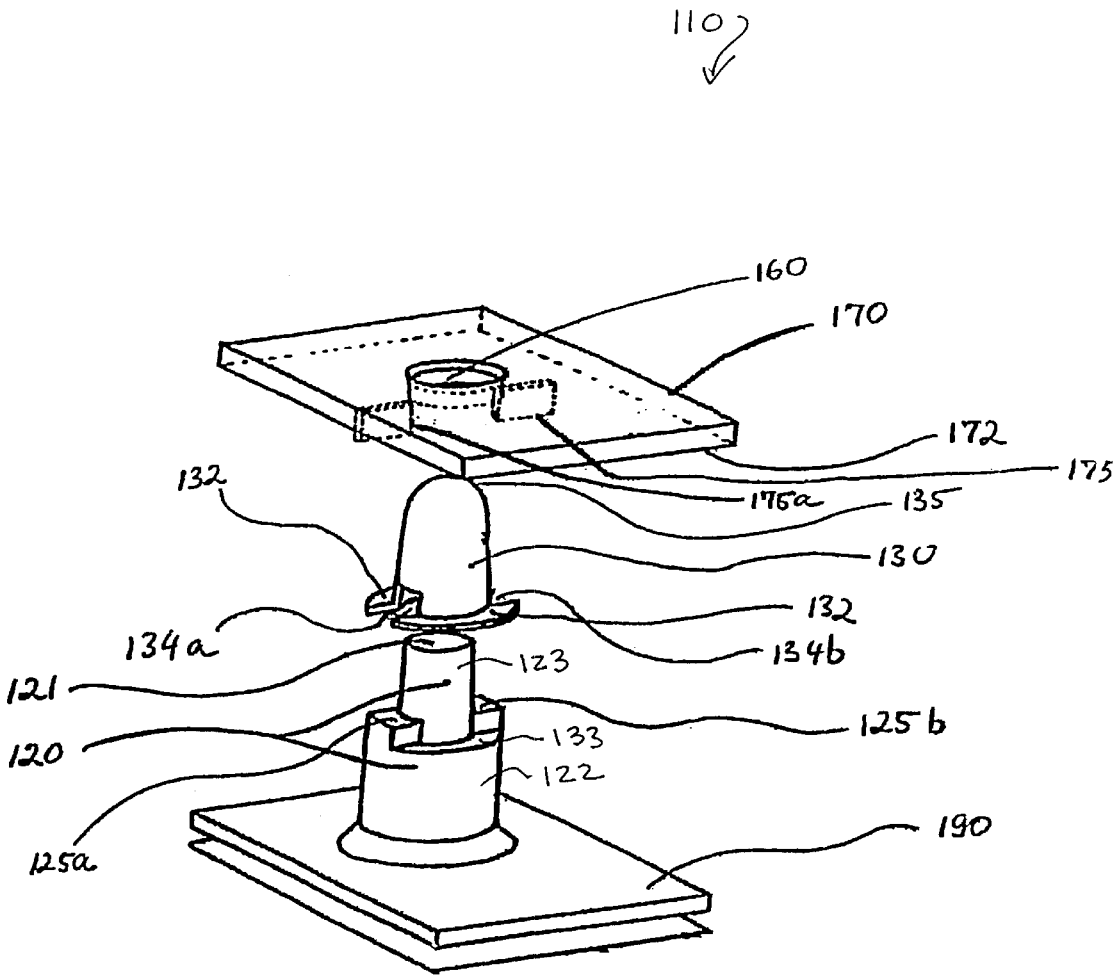
FIG. 5 is a disassembled view of a fifth type of a key unit according to the present invention.

FIG. 5 illustrates a fifth embodiment of the present invention. As shown in FIG. 4, key unit 110 has a plastic keycap 130 that is mounted on top of the resilient pad 120. The plastic keycap 130 extends in the axial direction through the pre-determined opening 160 in the top plate 170 of the keyboard to accommodate the axial movement of the resilient pad 120 and keycap 130 in response to the mechanical pressure in the axial direction that is applied by the keyboard operator to the top surface 135 of the plastic keycap 130.

Referring to FIGS. 4 and 5, impact and feedback noise are reduced or eliminated by a pair of resilient bumpers 125*a* and 125*b*, preferably made of a rubber material such as silicon rubber material, that come into contact with the stop of the top plate 170. These resilient bumpers may be ribs, ridges or extensions of the resilient pad 120 extending in the axial direction, as shown in FIGS. 3 and 4. The stop is preferably a pair of ribs 175*a* and 175*b* fixedly suspended from the inner surface 172 of the top plate 170 of the keyboard as shown in FIGS. 3 and 4. Alternatively, the stop may be provided by the top plate 170 of the keyboard itself as shown in FIG. 2A, or any other known means that would physically restrict the axial movement of the key unit by contact with the resilient bumpers 125*a* and 125*b* when the key unit returns from a depressed position to a normal position.

In the embodiment shown in FIG. 5, the plastic keycap 130 has a flange 132 that accommodates the resilient bumpers 125*a* and 125*b* through a pair of corresponding apertures 134*a* and 134*b* in the flange. This allows the resilient bumpers to come into physical contact with the stop provided by the pair of corresponding ribs 175*a* and 175*b*, instead of delimiting the axial movement of a key unit through the contact of the flange 132 and the stop, as in conventional key units known in the prior art. The flange 132 rests upon shoulder 133 of the resilient pad 120.

Referring to FIG. 5, the plastic keycap 130 preferably comprises a thicker button base as the upper part of the keycap. The upper surface 135 of the button base preferably contains the indicia of the key unit such as an alphanumeric symbol or other indicia.

Figure 6:
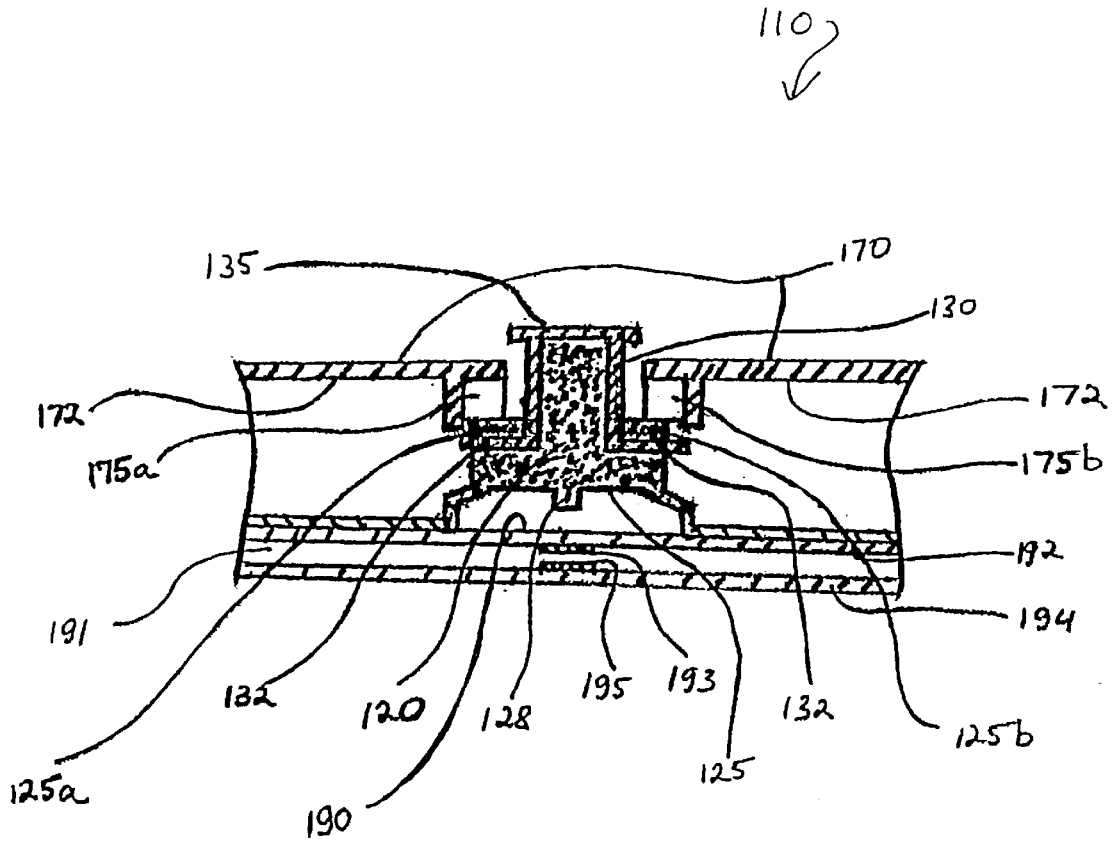
FIG. 6 is a sectional view of a key unit according to the present invention similar to that shown in FIG. 5.

As shown in FIG. 6, in the preferred embodiments of the current invention, the resilient pad 120 is mounted over a conductive membrane sheet structure 190 that is formed by two conductive layers and a gap in-between these layers. The conductive membrane sheet structure 190 produces an electrical signal in response to the mechanical pressure applied to the key unit. The conductive connection that produces the electrical signal of the key unit according to the present invention is accomplished in the same way as the conductive connection of a conventional key unit. The bottom surface 125 of the resilient pad 120 has a stem portion 128 that moves in unison with the pad 120 in the axial direction into contact with a surface contact point on upper sheet 192 of the conductive membrane sheet structure 190, thereby affecting the contact between the fixed contact 195 formed on the lower sheet 194 of the conductive membrane sheet structure 190 which may be formed on a circuit substrate (not shown) and the movable contact 193 of the upper sheet 192. The upper and lower sheets are separated from each other by a predetermined gap or air pocket 191. Alternatively a semi membrane, a PCB type of conductive membrane may be used as the means for producing an electrical signal in response to mechanical pressure enabled in the key unit. Such structure forms the electric contact and produces the signal to the keyboard apparatus in response to the contact between the stem portion 128 of the resilient pad 120 and a pre-determined contact point on the conductive membrane which may be formed on a circuit substrate. FIG. 5 further shows the key cap 130 having a button base in the upper part of the key cap. The upper surface of the button base 135 may contain indicia of the key unit. The bottom base may be a thicker part of the key cap 120.

Although the invention has been described with reference to the preferred embodiments, it will be apparent to one skilled in the art that variations and modifications are contemplated within the spirit and scope of the invention. The means for producing an electrical signal in response to mechanical pressure or movement may be any type of structure known such as a capacitive structure where the pressure changes the capacitance of circuit elements, a thermosensitive, inductive, photosensitive or piezoelectric structure. The drawings and description of the preferred embodiment are made by way of example rather than to limit the scope of the invention, and it is intended to cover withing the spirit and scope of the invention all such changes and modifications.

What is claimed is:

1. A key unit of an apparatus, wherein said key unit is able to assume a depressed position, and wherein said apparatus has a stop that restricts the movement of said key unit, said key unit further comprising:

a member moveable in a defined direction in response to pressure, said member having at least one bumper, said bumper moveable into contact with said stop of said apparatus, and a keycap mounted on said member, wherein said keycap comprises a flange that accommodates said at least one bumper of said member through at least one aperture in said flange into said contact with said stop of said apparatus.

2. A key unit as claimed in claim 1, wherein said apparatus has an electrical signal producing means for producing an electrical signal in response to said pressure, and wherein said member is mounted in a position above said electrical signal producing means, said member having a bottom surface being movable in said defined direction by said pressure to engage said electrical signal producing means.

3. A key unit as claimed in claim 1, wherein said member is a pad.

4. A key unit as claimed in claim 3, wherein said pad is made of a resilient material.

5. A key unit as claimed in claim 1, wherein said member and said at least one bumper of said member are made of a silicon rubber material.

6. A key unit as claimed in claim 1, wherein said apparatus has a top plate having an inner surface, and wherein said stop of said apparatus comprises at least one rib fixedly suspended from said inner surface of said top plate of said apparatus in said defined direction and restricting said movement of said key unit upon said contact with said at least one bumper of said member.

7. A key unit as claimed in claim 1, wherein said at least one bumper of said member extends along-side said keycap into contact with said stop of said apparatus.

8. A key unit as claimed in claim 1, wherein said keycap further comprises a button base in the upper part of said keycap, said base containing the indicia of said key unit.

9. An apparatus comprising:

at least one key unit being able to assume a depressed position; and a stop that restricts the movement of said at least one key unit; wherein said at least one key unit comprises:

a member moveable in a defined direction in response to pressure, said member having at least one bumper, said bumper moveable into contact with said stop of said apparatus, and wherein said key unit of said apparatus further comprises a keycap mounted on said member, and wherein said keycap of said key unit further comprises a flange that accommodates said at least one bumper through at least one aperture in said flange into said contact with said stop of said apparatus.

10. An apparatus claimed in claim 9, wherein said member of said key unit is mounted in a position above an electrical signal producing means for producing an electrical signal in response to said pressure applied to said at least one said key unit; said member having a bottom surface being movable by said pressure in said defined direction to engage said electrical signal producing means.

11. An apparatus claimed in claim 9, wherein said member of said key unit is made of a resilient material.

12. An apparatus claimed in claim 9, wherein said member of said key unit and said at least one bumper of said member are made of a silicon rubber material.

13. An apparatus claimed in claim 9, wherein said keycap mounted on said member for movement in unison with said member, wherein said at least one bumper of said member extends along-side said keycap into said contact with said stop of said apparatus when said key unit is returned from said depressed position.

14. An apparatus claimed in claim 9, wherein said keycap of said key unit further comprises a thicker button base in the upper part of said keycap, said base containing the indicia of said key unit.

15. An apparatus as claimed in claim 9, wherein said member comprises a restorative component.

16. An apparatus as claimed in claim 15, wherein said restorative component is a spring.

* * * * *